US007552719B2

(12) United States Patent
Joshi et al.

(10) Patent No.: US 7,552,719 B2
(45) Date of Patent: Jun. 30, 2009

(54) SOLENOID ASSEMBLY HAVING SLOTTED STATOR

(75) Inventors: Mandar A. Joshi, Dunlap, IL (US); Harish Krishnaswamy, Normal, IL (US); Dana R. Coldren, Secor, IL (US); Nadeem N. Bunni, Cranberry Township, PA (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/987,776

(22) Filed: Dec. 4, 2007

(65) Prior Publication Data

US 2009/0139491 A1 Jun. 4, 2009

(51) Int. Cl.
*F02M 51/00* (2006.01)
*F02M 51/06* (2006.01)

(52) U.S. Cl. ..... 123/490; 251/129.15

(58) Field of Classification Search ..... 123/490, 123/467; 251/129.15, 129.16, 129.01; 239/585.1, 239/585.3; 335/278, 281
See application file for complete search history.

(56) References Cited

U.S. PATENT DOCUMENTS 3,252,482 A * 5/1966 Kumm ..... 137/625.48
3,977,436 A * 8/1976 Larner ..... 137/625.65
4,812,884 A * 3/1989 Mohler ..... 335/258
4,997,004 A 3/1991 Barkhimer
5,083,747 A * 1/1992 Schmitt-Matzen ..... 251/129.21
5,102,095 A * 4/1992 Schmitt-Matzen et al. .. 251/117
5,137,132 A * 8/1992 Cerny ..... 192/84.961
5,207,410 A 5/1993 Wakeman
5,676,114 A 10/1997 Tarr et al.
6,155,503 A 12/2000 Benson et al.
6,168,135 B1 * 1/2001 Fochtman ..... 251/129.15
6,179,268 B1 * 1/2001 Seid ..... 251/65
6,628,186 B1 9/2003 Wölfges
6,883,544 B2 4/2005 Kawamura et al.
6,892,970 B2 * 5/2005 Nussio ..... 239/585.1
6,943,657 B2 9/2005 Subramanian et al.
6,982,619 B2 1/2006 Nussio
7,034,427 B2 4/2006 Hirzel
7,145,424 B2 12/2006 Schempp et al.
2006/0158055 A1 * 7/2006 Ivtsenkov ..... 310/156.01

* cited by examiner

*Primary Examiner*—Mahmoud Gimie
(74) *Attorney, Agent, or Firm*—Finnegan, Henderson, Farabow, Garrett & Dunner

(57) ABSTRACT

A solenoid assembly is disclosed. The solenoid assembly has a housing having a cavity disposed therein. The solenoid assembly also has a unitary stator having a plurality of separated portions. The separated portions are held together by at least one lip located on an outer periphery of the stator. The stator is sized to fit within the cavity disposed in the housing.

20 Claims, 4 Drawing Sheets

SOLENOID ASSEMBLY HAVING SLOTTED STATOR

TECHNICAL FIELD

This disclosure relates generally to solenoid assemblies, and more particularly, to solenoid assemblies having slotted stators.

BACKGROUND

Solenoid operated fuel injectors are used to inject fuel into the cylinder of internal combustion engines. A solenoid actuator of the solenoid operated fuel injector is energized to move a control valve element in a first direction to initiate an injection event and the actuator is de-energized to allow the control valve element to move in an opposite direction to end the injection event. In order to improve fuel economy and reduce emissions, fuel injection systems must be capable of achieving high injection pressures, controlling injection rates, and providing fast responses while maintaining accurate and reliable control of fuel metering and injection timing functions.

The ability of a fuel injector to respond to an input signal command to open significantly effects the ability of the fuel injector to deliver a precise injection of fuel to the combustion chamber. Parameters that define the fuel injector's magnetic circuit (e.g., the stator, the armature, and the working gap between the stator and armature) are particularly important since it is the magnetic circuit that conducts the magnetic flux that exerts the magnetic force which acts on the armature. The rate at which the magnetic flux builds determines the rate at which force acting on the armature builds. The faster the force builds, the faster the fuel injector responds. Additionally, minimizing the size of the solenoid actuator of the fuel injector is desirable, especially where the valve is mounted inside a fuel injector body.

Eddy currents play a significant role in the magnetic circuit and reducing eddy currents aid in faster response time of the fuel injector. For example, many stator cores are formed of a laminate stack assembly which permits faster magnetization and demagnetization of the solenoid by breaking up eddy current paths thereby reducing eddy currents.

Efforts have been made to minimize the size of solenoid actuators while providing the response time required in high speed, high pressure applications. For instance, the attractive force of the stator assembly of a solenoid actuator assembly can be increased by increasing the surface area of the stator pole end faces. The end face may be increased by sizing and shaping the stator assembly to occupy a maximum amount of the space in a surrounding housing. Nevertheless, the relatively small gap between the inner diameter of the housing and the outer diameter of the stator causes flux leakage into the surrounding housing. Generally, sizing and shaping the stator assembly to occupy a maximum amount of space in a surrounding housing requires designing the inner diameter of the housing and the outer diameter of the stator to very close tolerances.

Various solenoid assembly designs that increase attractive forces, reduce eddy currents and reduce flux leakage have been developed. One such example is described in U.S. Pat. No. 6,155,503 (the '503 patent) issued to Benson et al. on Dec. 5, 2000. The '503 patent includes a solenoid stator assembly positioned in an actuator housing and a flux dissipation reducing feature to minimize flux leakage into the housing and thus maximize the attractive force, which in turn improves valve response time. The flux dissipation reducing feature disclosed in the '503 patent includes a slot formed in the housing adjacent each outer face of the solenoid stator pole pieces. The slots permit the cross sectional area of the pole pieces to be maximized thereby increasing the available attractive force. In addition, the slots increase the resistivity of the magnetic circuit and reduce eddy currents.

The apparatus of the '503 patent may not adequately reduce the gap between the stator and the surrounding housing. Furthermore, the design of the '503 patent may require tight tolerances for a close fit of the stator within the housing, which may make manufacturing the design expensive. In addition, the design disclosed in the '503 patent only applies to E-type laminate stack assemblies, and other stator designs would not benefit. In particular, it may not be practical to incorporate the slots from the E-type laminate stack in other stator designs and thereby reduce eddy currents. Thus, the system described in the '503 patent may be ineffective in situations where a non E-type laminate stack stator is required, in situations where the gap between the stator and the surrounding housing must be further reduced, and in situations where eddy currents must be reduced.

SUMMARY

In one aspect, the present disclosure is directed to a solenoid assembly. The solenoid assembly includes a housing having a cavity disposed therein. The solenoid assembly also includes a unitary stator having a plurality of slots. The stator is held together by a lip that is located on an outer periphery of the stator and remains after the slots are cut so that the stator remains one-piece. The stator is further configured to fit within the cavity disposed in the housing.

In another aspect, the present disclosure is directed to a method of forming a solenoid assembly. The method includes cutting a plurality of slots in a stator and leaving a lip on the outer periphery of the stator to hold the stator together in one-piece. The method also includes compressing the stator and placing it in a housing having an inner cavity configured to receive the stator. The method further includes expanding the stator so that it fits snugly within the geometric contours of the cavity and attaching the stator to the housing.

DETAILED DESCRIPTION

Figure 1:
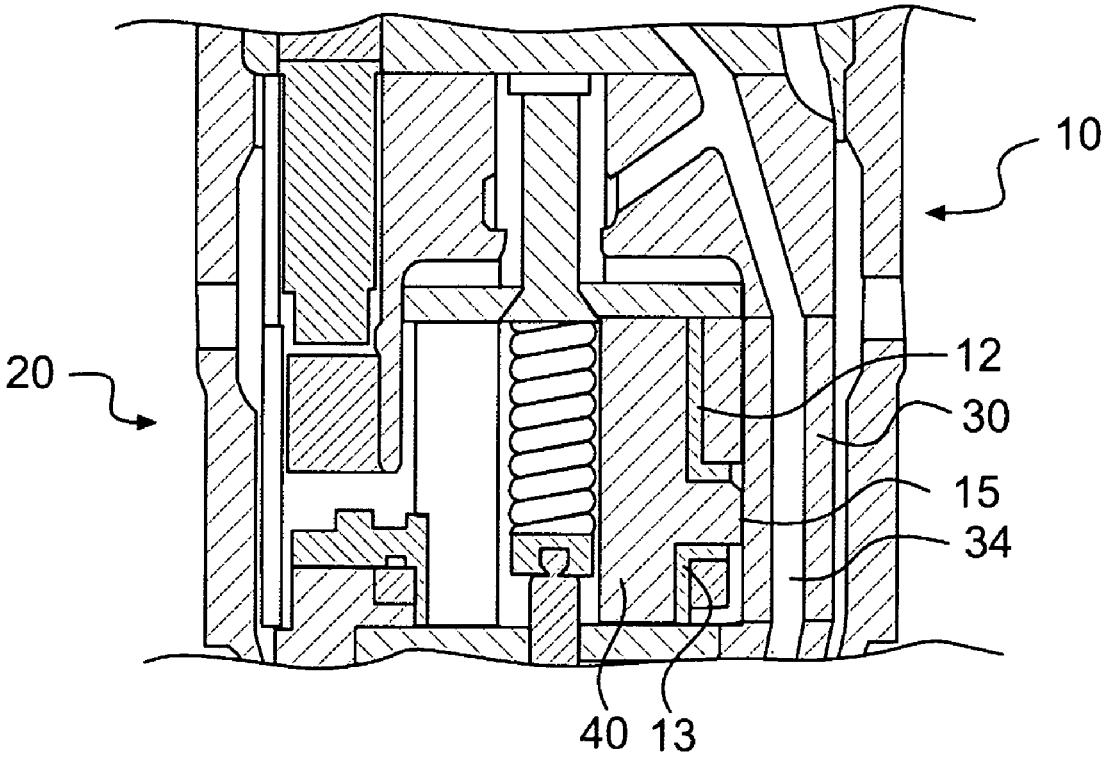
FIG. 1 is a partial cross-sectional illustration of a fuel injector, including a partial cross sectional view of an exemplary solenoid assembly of FIG. 2 taken along plane 1-1.
Figure 2:
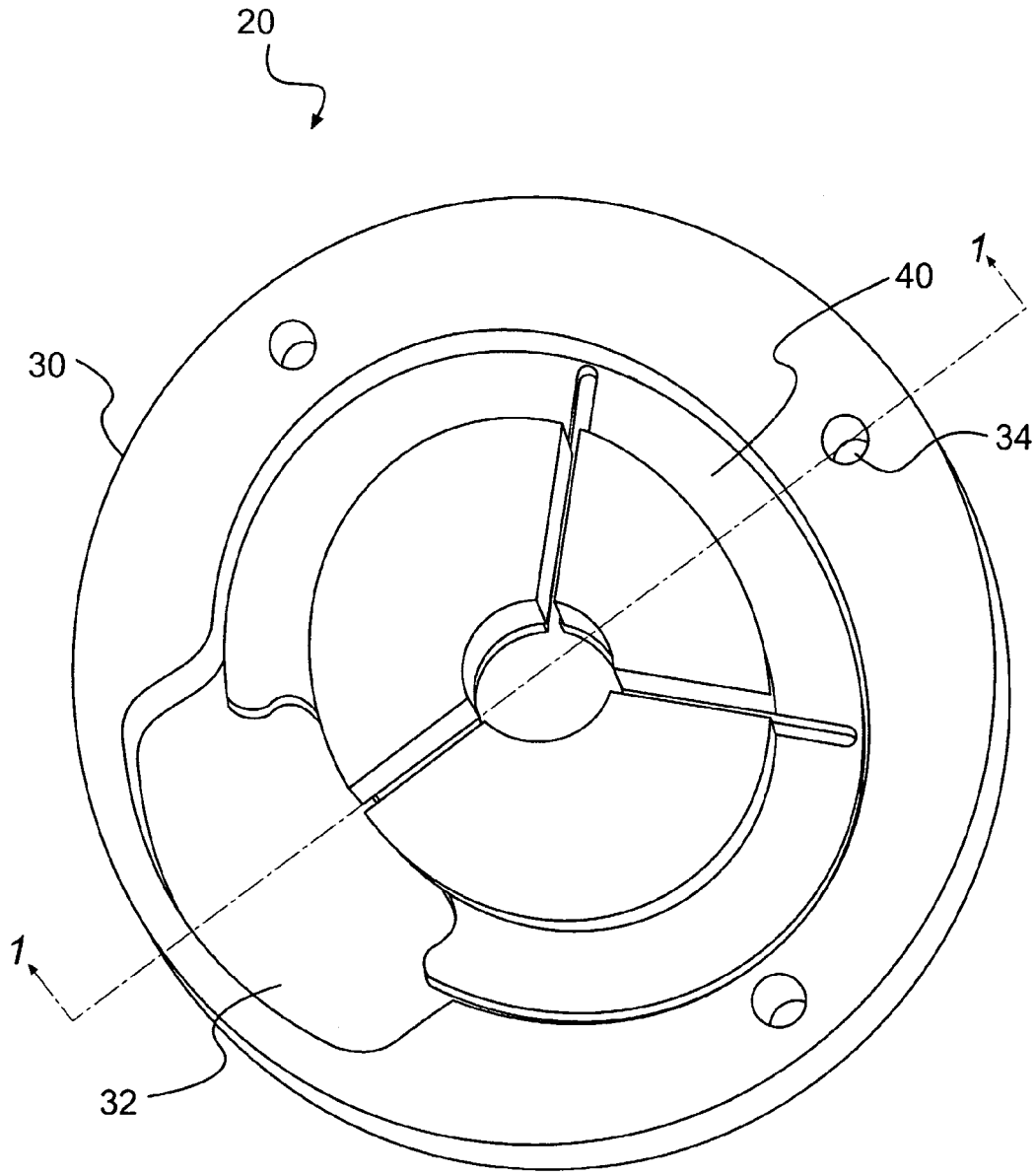
FIG. 2 is a diagrammatic illustration of the exemplary disclosed solenoid assembly.

FIG. 1 illustrates a partial cross-sectional illustration of a fuel injector, including a partial cross sectional view of an exemplary solenoid assembly 20 of FIG. 2 taken along plane 1-1. Fuel injector 10 may be part of a fuel injection system (not shown) and may be in fluid communication with a fuel supply system. Fuel injector 10 may inject metered amounts of fuel into a combustion chamber of an internal combustion engine (not shown). One of ordinary skill in the art would appreciate that fuel injector 10 may be any fuel injector known in the art.

FIG. 2 is a diagrammatic illustration of the solenoid assembly 20 of FIG. 1. Referring to FIGS. 1 and 2, solenoid assembly 20 may include a housing 30. Housing 30 may serve as an outer pole of solenoid assembly 20 and may be made of any suitable material. Housing 30 may include a high pressure passage 34 in fluid communication with a high pressure source (not shown). Housing 30 may have an elliptical cavity 32 disposed therein and configured to receive stator 40. Cavity 32 may be undersized relative to stator 40, and may be configured to receive stator 40 when stator 40 is compressed to a smaller shape. One of ordinary skill in the art would appreciate that cavity 32 may be of any suitable shape configured to receive a stator 40 of corresponding shape.

Figure 3:
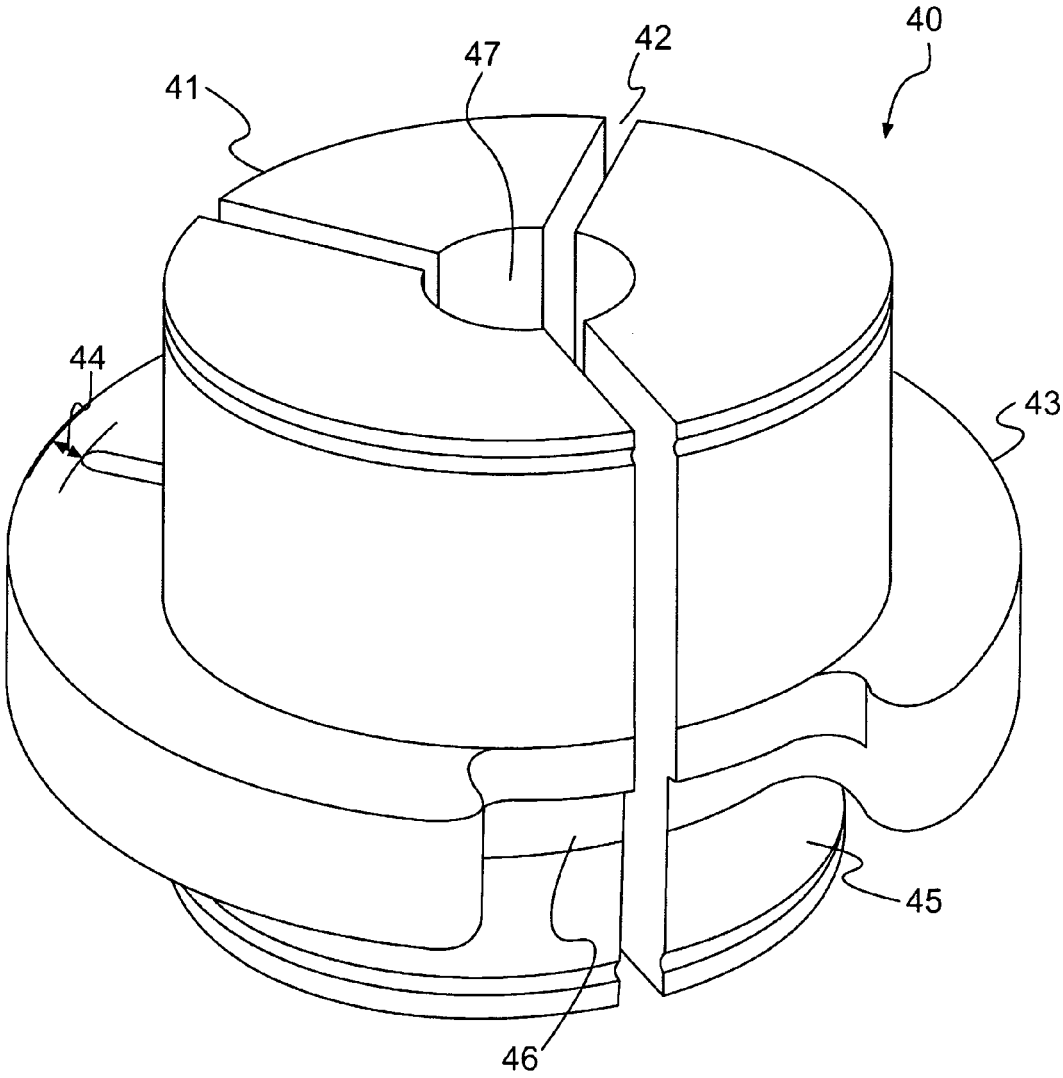
FIG. 3 is a diagrammatic illustration of an exemplary stator consistent with certain disclosed embodiments.

FIG. 3 is a diagrammatic illustration of an exemplary stator 40 consistent with certain disclosed embodiments. Stator 40 may serve as an inner pole of solenoid assembly 20 and may include a top portion 41 and a bottom portion 45. Top portion 41 and bottom portion 45 may be configured to receive coil assemblies 12 and 13. Coil assemblies 12 and 13 may be any suitable coil assemblies known in the art. Stator 40 may include an annular flange 43 disposed between the top portion 41 and the bottom portion 45. Flange 43 may include a recess 46. Stator 40 may have an elliptical shape and may be made of a metal injection molded iron silicone material. In addition, stator 40 may be configured to be received by housing cavity 32. Alternatively, stator 40 may have a circular shape, and it should be appreciated that stator 40 may have any suitable shape compatible with housing cavity 32 and may be made of any suitable process and material.

Stator 40 may include a central passageway 47. Central passageway 47 may have a plurality of slots 42 extending radially therefrom and may form a plurality of separated portions. The slots 42 may be evenly or unevenly spaced from each other and may include two or more slots. As shown in FIG. 3, stator 40 may include three slots with at least one slot 42 passing through recess 46. The slots 42 may be cut in stator 40 by water jet techniques or any cutting method known to one of ordinary skill in the art and appropriate for the stator material. Slots 42 may break through top portion 41 and bottom portion 45. However, slots 42 may only partially break through flange 43. That is, a lip 44 may remain after slots 42 are cut such that stator 40 maintains its unitary structure.

Lip 44 may have a thickness of approximately 0.25 millimeters and may be located at an outer periphery of flange 43. Alternatively, lip 44 may be located at any appropriate location and have any appropriate size that maintains the unitary structure of stator 40.

Once the stator 40 is positioned within housing 30, stator 40 and housing 30 may be permanently attached by any method appreciable to one of ordinary skill in the art such as gluing or mechanical means. In one embodiment, stator 40 and housing 30 may be permanently attached, at a location depicted as 15 in FIG. 1, by laser welding techniques or any other suitable welding technique.

INDUSTRIAL APPLICABILITY

The disclosed solenoid assembly 20 may be used in conjunction with any fuel injector 10 in any fuel injection system, such as an internal combustion engine, a work tool actuation system, or any fuel delivery system. The disclosed solenoid assembly 20 may provide a mechanism for reducing valve response time and may provide ease of manufacturability and assembly. The operation of solenoid assembly 20 will now be explained in detail.

Figure 4:
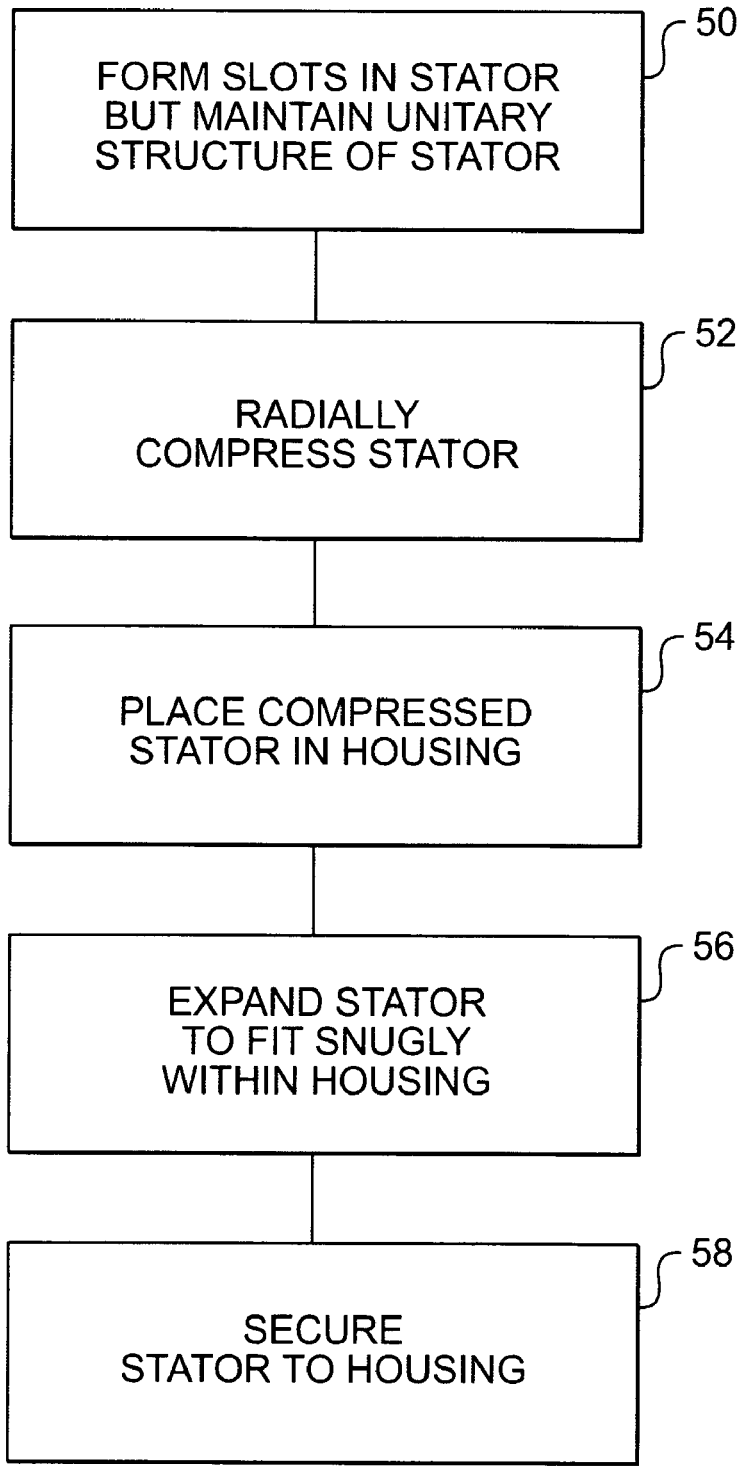
FIG. 4 is a flow chart illustrating an exemplary process for assembling the solenoid assembly consistent with certain disclosed embodiments.

FIG. 4 is a flow chart illustrating an exemplary process for assembling the solenoid assembly. Slots 42 may be cut in stator 40 but a lip 44 may be kept after slots 42 are cut such that the stator 40 maintains its unitary structure (Step 50). Stator 40 may then be radially compressed to a smaller shape (Step 52) and placed in a housing 30 having a cavity 32 configured to receive the stator 40 (Step 54). Once the stator 40 is inserted in housing 30, the stator 40 may be allowed to expand to fit snugly within housing 30 (Step 56). That is, the stator 40 may be allowed to expand such that its outer diameter touches the inside contours of cavity 32 and fits snugly therein (Step 56). A mandrel may be used to assist the stator 40 to expand and fit snugly within housing 30. It is contemplated any other appropriate technique known to one of ordinary skill may be employed to assist in the expansion of stator 40. Slots 42 may allow the stator 40 to be compressed and expanded. Because stator 40 is able to be compressed and expanded, neither stator 40 nor housing 30 have to be machined to very tight tolerances, thereby, reducing manufacturing expense. Moreover, the inherent gap between the outside diameter of stator 40 and the cavity 32 of housing 30 is significantly minimized without having to machine stator 40 and/or housing 30 to very tight tolerances, further reducing manufacturing and assembly expense.

In addition, assembling solenoid assembly 20 is further simplified by having the stator 40 maintain its unitary structure. That is, when slots 42 are cut, a lip 44 is left such that the stator 40 remains one piece. Therefore, there is no need to handle different pieces of the stator 40 since the stator 40 remains one-piece. This enhances ease of manufacturability and assembly by saving time and expense associated with handling the stator 40. Once stator 40 has been snugly placed in cavity 32 of housing 30, the stator 40 and the housing 30 may be permanently attached (Step 58). The stator 40 and housing 30 may be permanently attached by laser welding for example. In particular, the outer edge of flange 43 may be laser welded to the cavity 32 of housing 30. However, welding may be avoided in the vicinity of the high pressure passage 34.

During assembly, slots 42 aid in minimizing the gap between housing 30 and stator 40, which helps prevent flux leakage into the housing 30. Because stator 40 may be compressed and expanded while inserted in cavity 32, stator 40 may occupy maximum space within cavity 32 within housing 30. In addition, slots 42 aid in reducing the effect of eddy currents by making the path of the eddy currents more tortuous. Thus, the magnetic circuit gains strong attractive forces, resulting in a decrease in response time of the actuator and better control of fuel injection timing and metering.

It will be apparent to those skilled in the art that various modifications and variations can be made to the disclosed solenoid assembly and other embodiments will be apparent to those skilled in the art from consideration of the specification and practice of the solenoid assembly. Accordingly, it is intended that the specification and examples be considered as exemplary only, with a true scope being indicated by the following claims and their equivalents.

What is claimed is:

1. A solenoid assembly, comprising:

a housing having a cavity disposed therein; and a unitary stator having a plurality of separated portions divided by radially extending slots and held together by at least one lip located on an outer periphery of the stator, the stator being sized to fit within the cavity disposed in the housing.

2. The solenoid assembly of claim 1, wherein the radially extending slots include three slots that extend from a central passageway.

3. The solenoid assembly of claim 1, wherein the stator is fixedly coupled to the housing.

4. The solenoid assembly of claim 1, wherein the stator has an elliptical shape.

5. The solenoid assembly of claim 1, wherein the stator includes a top portion, a bottom portion, and a flange disposed between the top portion and the bottom portion.

6. The solenoid assembly of claim 5, wherein the at least one lip is located on the flange.

7. The solenoid assembly of claim 5, wherein the radially extending slots extend through the top portion and the bottom portion and only partially extending through the flange.

8. The solenoid assembly of claim 5, wherein the flange includes a recess.

9. A method of forming a solenoid assembly including:

forming a plurality of internal slots in a stator and leaving lip on an outer periphery of stator to maintain unitary structure of stator, the slots extending radially from the stator;

compressing the stator and placing it in a housing having an inner cavity configured to receive the stator;

expanding the stator so that it contacts the housing; and securing the stator to the housing.

10. The method of claim 9, further including permanently securing the stator to the housing.

11. The method of claim 9, further including forming three internal slots in the stator.

12. The method of claim 9, wherein compressing the stator and placing it in the housing having an inner cavity configured to receive the stator includes:

undersizing the cavity within the housing relative to the stator; and compressing the stator so that it fits within the cavity.

13. The method of claim 9, wherein forming the plurality of internal slots in the stator includes cutting slots in a top portion, a bottom portion, and a flange disposed between the top portion and the bottom portion of the stator.

14. The method of claim 13, wherein forming the plurality of internal slots in the stator includes forming slots that extend completely through the top portion and the bottom portion but only partially through the flange.

15. The method of claim 9, wherein the stator has an elliptical shape.

16. A fuel injector comprising:

a solenoid assembly;

the solenoid assembly including a housing having a cavity disposed therein; and a unitary stator having a central passageway and a plurality of slots extending radially outward from the central passageway, the stator being held together by a lip located on an outer periphery of the stator and sized to fit within the cavity disposed in the housing.

17. The fuel injector of claim 16, wherein the plurality of slots include three slots.

18. The fuel injector of claim 16, wherein the stator has an elliptical shape.

19. The fuel injector of claim 16, wherein the stator is permanently coupled to the housing.

20. The fuel injector of claim 16, wherein the stator includes a top portion, a bottom portion, and a flange, and wherein the lip is located on the flange and the flange is annularly disposed between the top portion and the bottom portion.

* * * * *